US005295930A

United States Patent [19]

Hogan

[11] Patent Number: 5,295,930

[45] Date of Patent: Mar. 22, 1994

[54] EXERCISE DEVICE SIMULATING DOWNHILL SKIING

[76] Inventor: John W. Hogan, 135 Crestview Dr., Park City, Utah 84060

[21] Appl. No.: 944,083

[22] Filed: Sep. 11, 1992

[51] Int. Cl.[5] ..... A63B 69/18

[52] U.S. Cl. ..... 482/71; 482/130

[58] Field of Search ..... 482/71, 68, 79, 146, 482/147, 70

[56] References Cited

U.S. PATENT DOCUMENTS 4,595,195 6/1986 Miehlich ..... 482/71

4,783,069 11/1988 Cottee ..... 482/71

FOREIGN PATENT DOCUMENTS 0287408 2/1991 Fed. Rep. of Germany ..... 482/71

*Primary Examiner*—Stephen R. Crow

*Attorney, Agent, or Firm*—Terry M. Crellin

[57] ABSTRACT

An exercise device that simulates downhill skiing as well as thoroughly exercises one's body and cardiovascular system comprises a base support member that rests on the floor or ground. An elongate support member is pivotally attached to the base support member for pivotal, swaying movement about a longitudinal axis adjacent to the base support member. A biasing mechanism is associated with the elongate support member for exerting a biasing force to bias the elongate support member toward an upstanding position. A platform for supporting a person in a standing position thereon is pivotally attached to a distal end of the elongate support member. As the elongate support member sways back and forth, the platform moves in an arcuate, swinging motion. A forward member extends upwardly from the base support member and has hand engagement means which a person standing on the platform can grasp to maintain balance as the person pushes the platform downwardly in alternating movements first to one side of a vertical plane extending through the longitudinal axis and then to the other side of the vertical plane in a motion simulating turns in downhill skiing.

8 Claims, 5 Drawing Sheets

EXERCISE DEVICE SIMULATING DOWNHILL SKIING

BACKGROUND OF THE INVENTION

1. Field of the Invention

The present invention relates to devices for exercising one's body and cardiovascular system. In particular, the present invention relates to such exercising devices that simulate the coordinated up and down movement of one's legs and feet as well as the shifting of one's weight in a manner similar to such motions occurring in downhill skiing.

2. State of the Art

There have been various devices disclosed in the prior art that are supposed to simulate different aspects of skiing. Popular commercial devices are available that simulate cross country skiing. These devices have parallel tracks, with foot engagement members that slide back and forth along the respective tracks. These devices do not, however, simulate downhill skiing to any extent.

In U.S. Pat. No. 4,953,858, there is disclosed that exercises the lower body muscles in a manner somewhat simulating downhill skiing. The device consists of a sloping rotatable platform having biasing means for increasing the force necessary to rotate the platform either clockwise or counter-clockwise from a neutral position. This device does not provide for lifting and pushing with ones legs in a coordinated fashion or the shifting of one's weight and lateral movement of one's feet as a unit from side to side as is incurred in actual downhill skiing.

In U.S. Pat. No. 5,125,880, a ski simulation exercise device is disclosed which is of the slant board type exerciser. A roller provides guided, rolling support as a slant board type support is rolled over and across the guide roller. This device allows shifting of weight from one foot to the other, but the user's legs do not move in coordinated up and down movement nor to the user's feet move in a lateral displacement as a unit as in actual downhill skiing. Further, the technique for balancing and shifting one's weight on a rolling slant board does not actually simulate downhill skiing.

3. Objective

The principal objective of the invention is to provide a novel exercising device that achieves thorough exercising of one's body and cardiovascular system while simultaneously simulating faithfully the movements occurring in downhill skiing by providing movement of ones legs up and down in a coordinated action, shifting of one's weight from side to side and moving of one's feet as a unit from side to side.

BRIEF DESCRIPTION OF THE INVENTION

The above broad objective of the present invention is achieved in accordance with the present invention by providing a novel exercising device in which the user stands on a platform with his or her feet held together in side-by-side relationship. The user assumes a crouched position on the platform as if the user were actually skiing downhill on a pair of skis.

The platform is adapted to move laterally from side to side in an over center, arcuate movement as the user shifts his or her weight and pushes down on the platform. Biasing means are provided for returning the platform to the center position as the user pulls upwardly with his feet, and, of course, the biasing means provides a force against which the user must push in moving the platform sideways and downwardly from its center position.

The exercise device of the present invention provides thorough exercise for one's body and cardiovascular system in an enjoyable routine that faithfully simulates weight shifting, up and down leg movement and lateral movement of the feet as incurred in actual downhill skiing.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

Figure 2:
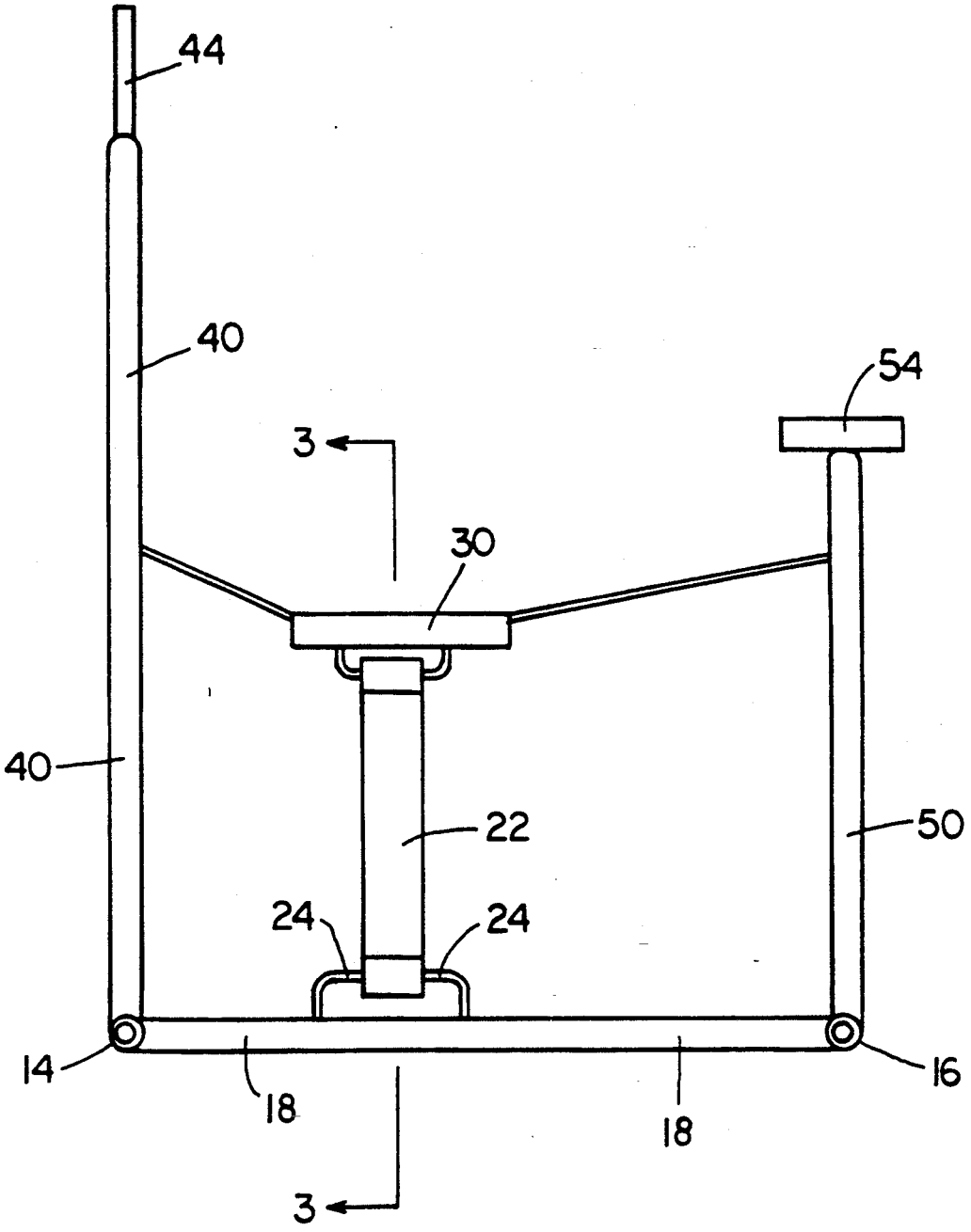
FIG. 2 is a side elevation of the exercise device of FIG. 1.
Figure 4:
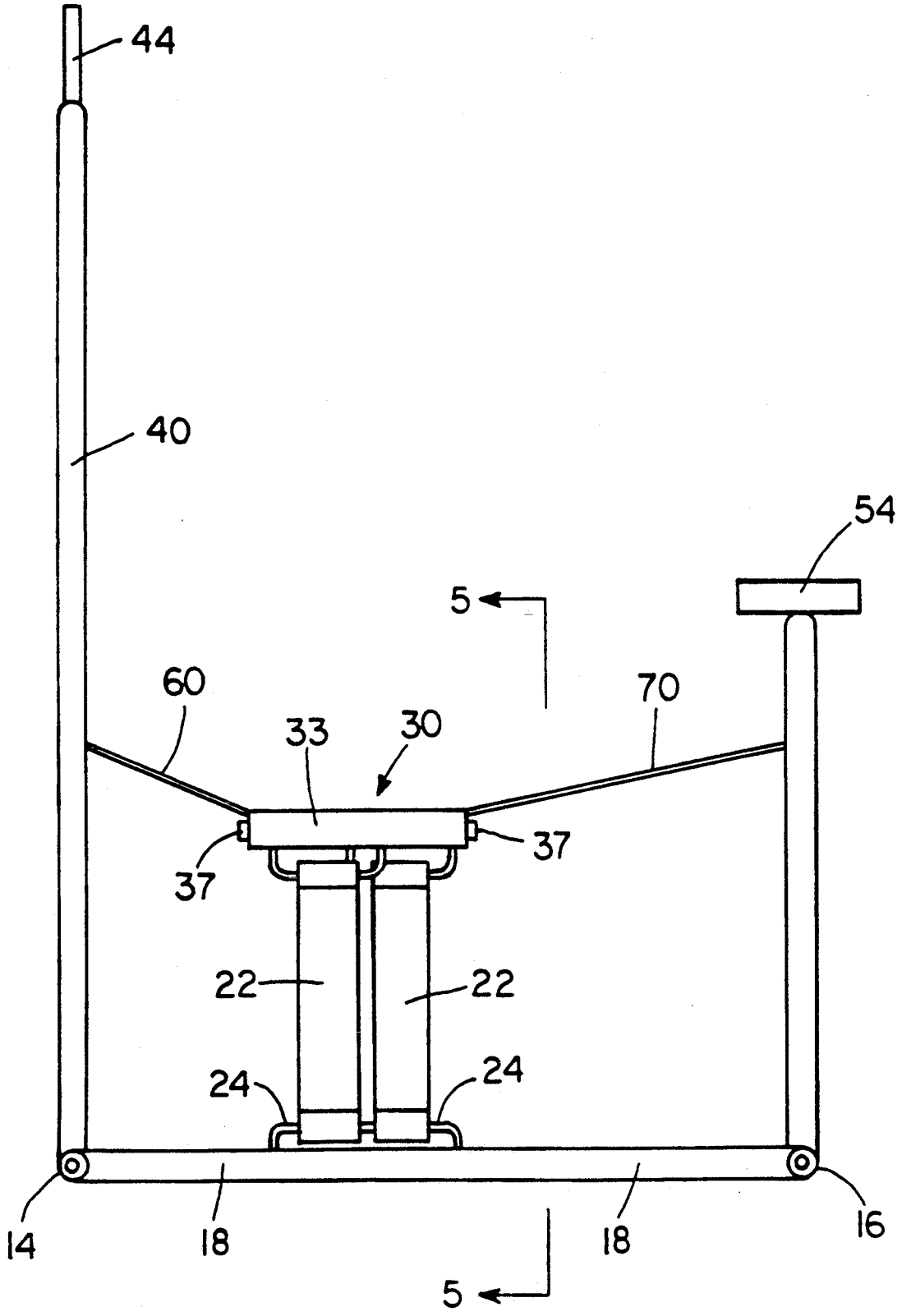
Figure 5:
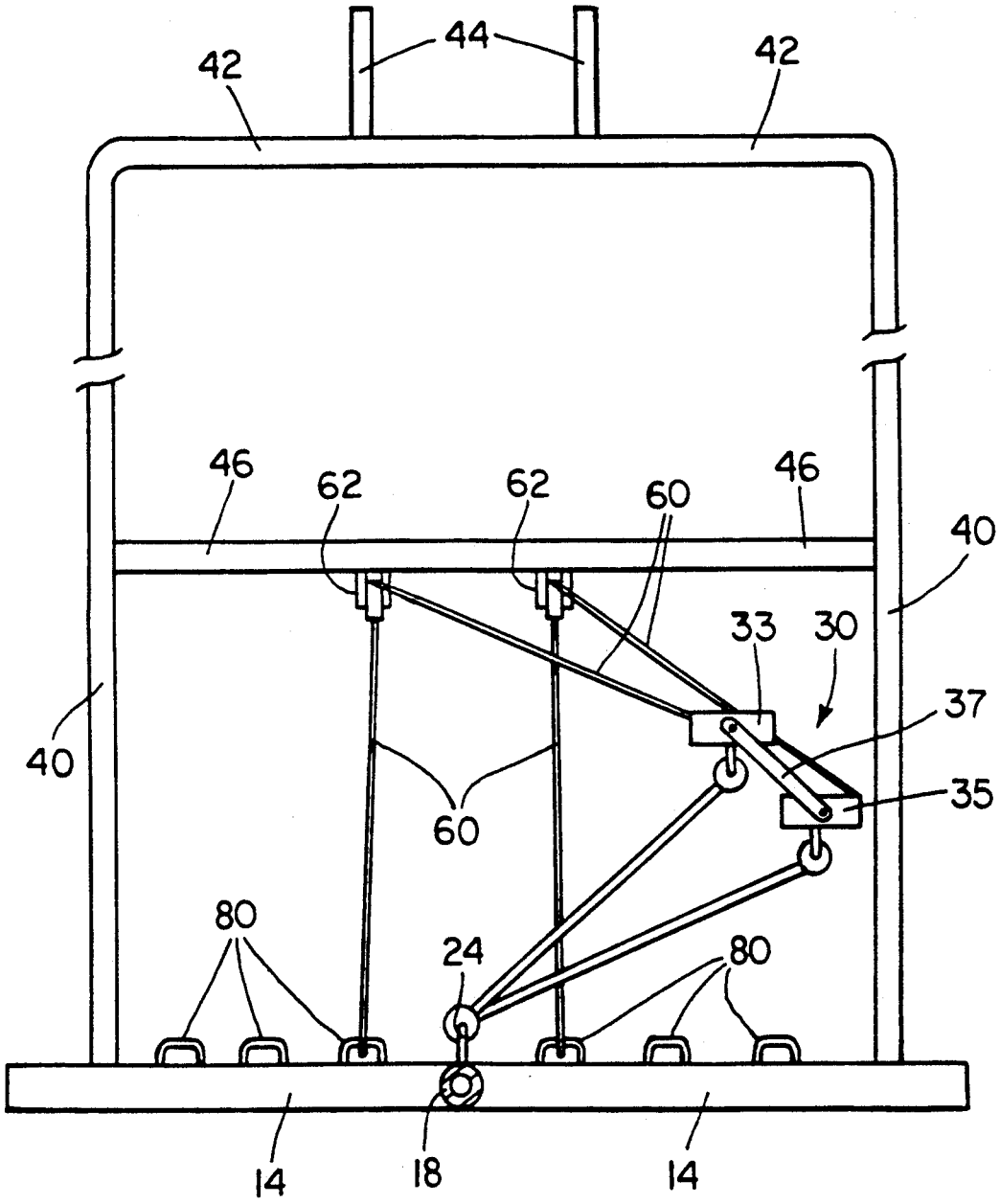

FIG. 4 is a side elevation similar to that of FIG. 2 but showing a modified embodiment of the exercise device of the present invention in which the platform is formed of two side-by-side sections that can move up and down relative to each other as the platform moves from side-to-side in its arcuate movement; and FIG. 5 is a transverse elevational view taken along line 5—5 of FIG. 4 showing the platform in a right lateral and downward displacement.

DETAILED DESCRIPTION OF THE ILLUSTRATED EMBODIMENTS

As illustrated in the drawings, an exercise device 10 is shown that simulates downhill skiing to develop skiing skills as well as to thoroughly exercise one's body and cardiovascular system. The exercise device comprises a base support member that rests on the floor or ground. The base support member as illustrated is formed by an elongate element 14 forming the front end of the base support member, and another elongate element 16 forms the back end of the base support member. A longitudinal beam 18 extends from the front end 14 to the back end 16 of the base support. Preferably, the longitudinal beam 18 joins the midpoints of the elongate elements 14 and 16 to form an essentially flat, H-shaped base support member that rests on a suitable support such as a floor or the ground.

Figure 3:
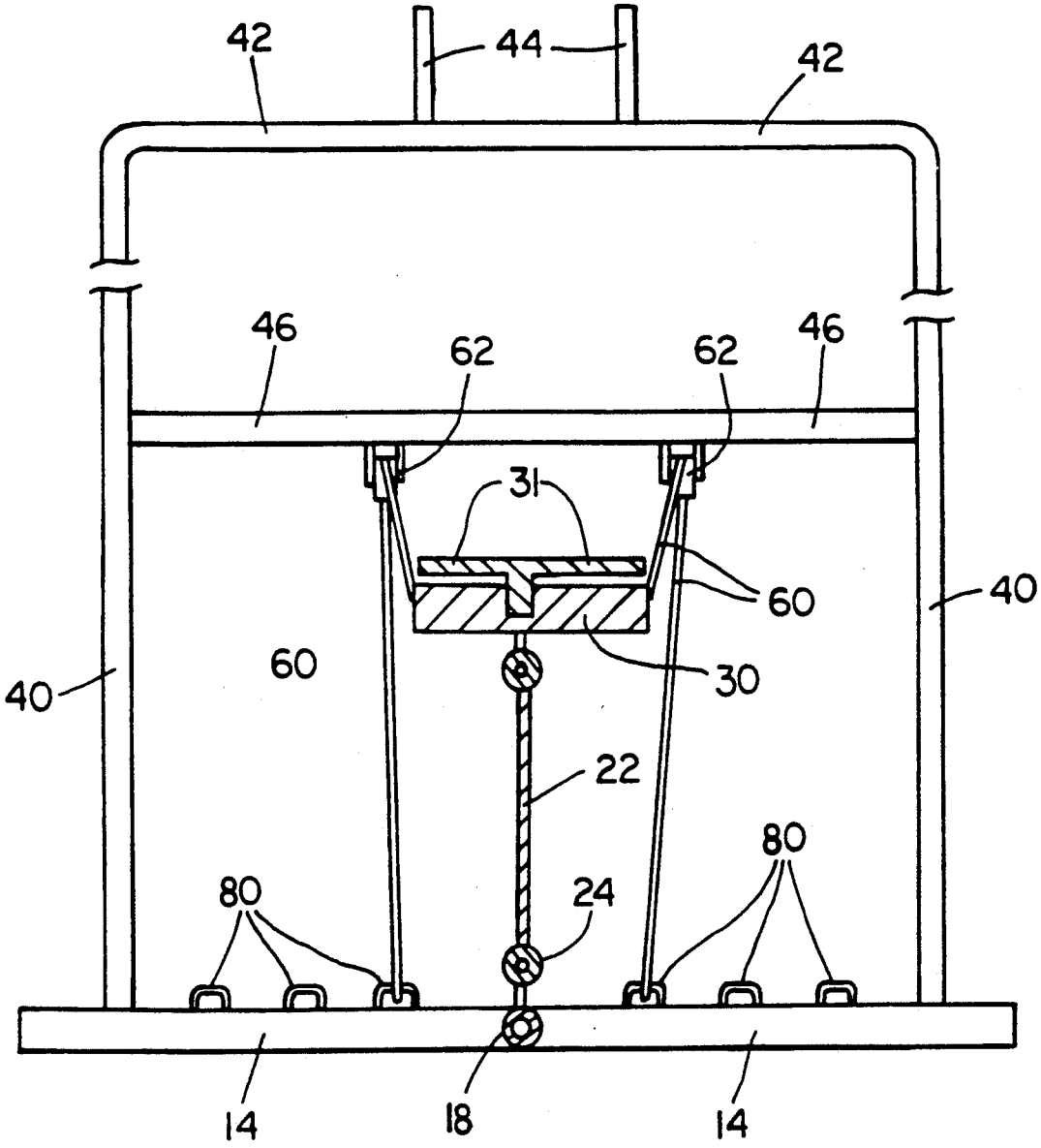
FIG. 3 is a lateral cross section through the exercise device of FIGS. 1 and 2 taken along line 3—3 of FIG. 2, with the pedestal shown in FIG. 2 being adapted to have a rotating upper surface.

An elongate platform support member 22 is pivotally attached to the longitudinal beam 18 for pivotal, swaying movement about a pivot axis that is substantially parallel with the longitudinal beam 18. As best shown in FIGS. 2–4, a pivot rod 24 forms the pivot axis, with the pivot rod 24 being attached at its opposite ends to the upper surface of the longitudinal beam 18 so that the pivot axis is spaced upwardly from the upper surface of the longitudinal beam 18.

The elongate platform support member 22 extends upwardly from the base support member, i.e., from its pivotal attachment to the longitudinal beam 18, such that the elongate support member 22 pivots about the pivot axis formed by the pivot rod 24 to sway back and forth in a windshield wiper type motion above the base support member. As illustrated, the elongate support member 22 extends substantially vertically upwardly from its pivotal attachment to the longitudinal beam 18 and sways back and forth in a vertical plane that is essentially perpendicular to the longitudinal axis of the longitudinal beam 18. However, it should be recognized that the elongate support member 22 could be oriented at an acute angle with the longitudinal beam 18 wherein it would sway back and forth in a plane that is slanted at an acute angle with the longitudinal beam 18.

Biasing means are associated with the elongate support member 22 and the platform 30. A particularly preferred embodiment of the biasing means will be described further hereinafter. The biasing means exerts a biasing force on the elongate support member 22 and the platform 30 to bias the elongate support member 22 and the platform 30 toward an upstanding position in which the elongate support member 22 lies at or closely adjacent to a vertical plane through the pivot axis formed by the pivot rod 24.

Figure 1:
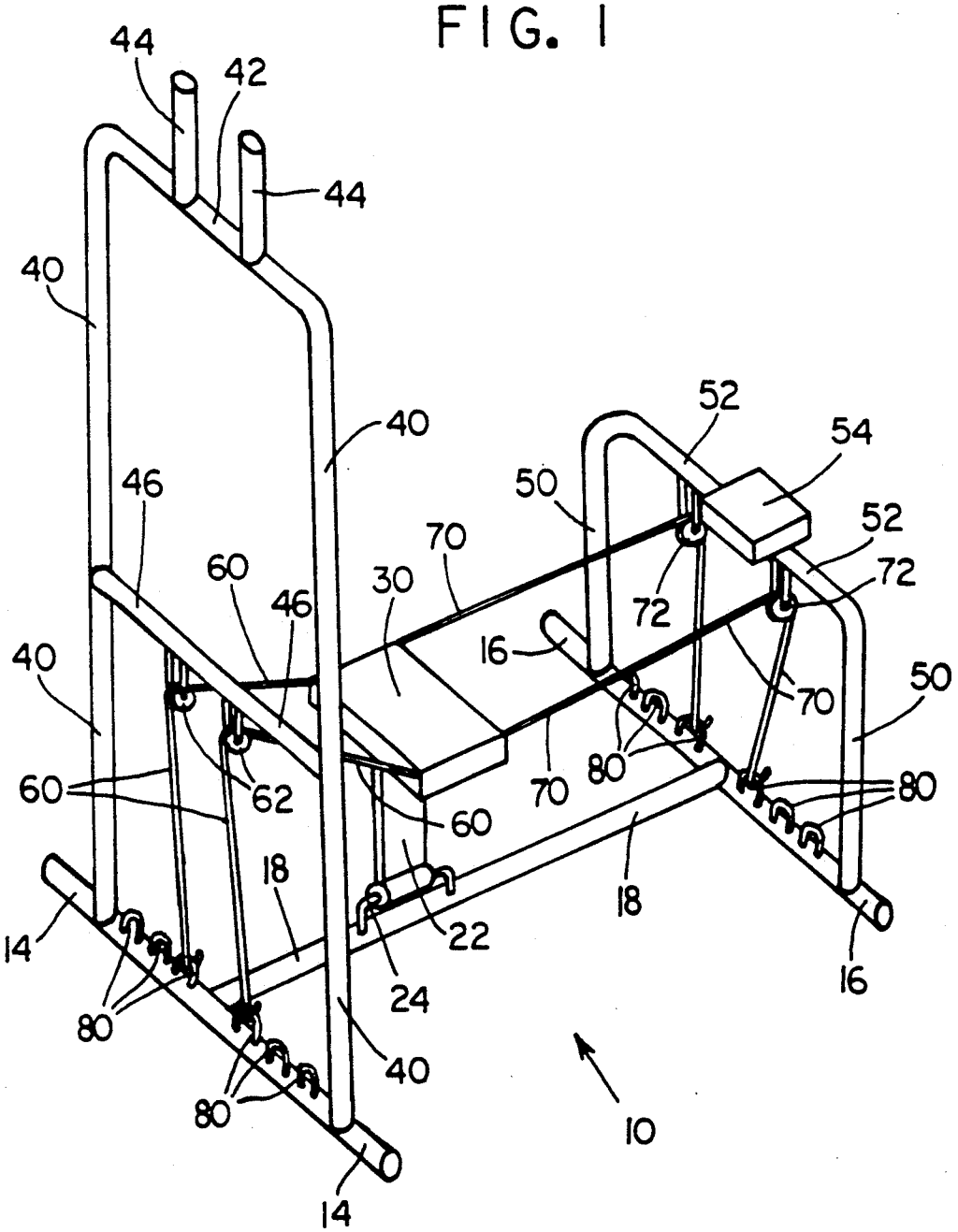
FIG. 1 is a pictorial representation of a preferred embodiment of the exercise device of the present invention.

The upwardly extending position that the elongate support member 22 is biased to by the biasing means is essentially the upright, center position in the swaying motion of the elongate support member 22. When a single elongate support member 22 is used as shown in FIGS. 1-3, the center position will lie essentially in a vertical plane through the pivot axis formed by the pivot rod 24. However, when two elongate support members 22 are used as shown in the embodiment illustrated in FIGS. 4 and 5, the two elongate support members 22 are attached to two side-by-side, spaced sections 33 and 35 that form the platform 30 as will be discussed further hereinafter. In such an embodiment, elongate support members 22 and platform 30 are biased toward a position in which the space between the two side-by-side sections 33 and 35 of the platform 30 will lie directly above the pivot axis formed by the pivot rod 24 in the vertical plane passing through the pivot axis, and the elongate support members 22 will be in upright positions lying closely adjacent to the vertical plane through the pivot axis.

The platform 30 is positioned at the end of the elongate support member or members 22 for supporting a person in a standing position thereon. The platform 30 is pivotally attached to the distal end of the elongate support member 22 that extends upwardly from the base support member, i.e., from the longitudinal beam 18. As the elongate support member 22 sways back and forth, the platform 30 moves in an arcuate, swinging motion in a substantially vertical plane that is substantially perpendicular to the pivot axis formed by the pivot rod 24.

A forward member extends upwardly from the elongate element 14 forming the front end of the base support member, with the forward member including hand engagement means which a person standing on the platform 30 can grasp to maintain balance as the person pushes the platform outwardly and downwardly in alternating movements first to one side of the vertical plane extending through the pivot axis formed by the pivot rod 24 and then to the other side of the vertical plane extending through the pivot axis in a motion simulating turns in downhill skiing.

As shown in the drawings, the forward member preferably comprises an inverted, U-shaped member having two upstanding elongate legs 40 attached at respective one ends thereof to elongate member 14 forming the front end of the base support member. The upper ends of the upstanding elongate legs 40 are connected together by an elongate cross member 42 that forms the base of the inverted, U-shaped member. The hand engagement means comprises a pair of spaced apart, elongate, hand grip members 44 extending substantially upwardly from the elongate cross member 42.

The exercise device of the present invention preferably further includes a rearward member comprising a second, inverted, U-shaped member that has two upstanding elongate legs 50 attached at respective one ends thereof to the elongate element 16 forming the back end of the base support member. The upper ends of the upstanding elongate legs 50 of the rearward member are connected together by an elongate cross member 52 that forms the base of the second, inverted, U-shaped member. A seat 54 is advantageously mounted on the elongate cross member 52 that forms the base of the second, inverted, U-shaped member. The seat 54 forms a convenient aid in mounting and demounting from the exercise device.

As mentioned previously, biasing means are provided for biasing the elongate support member 22 and the platform 30 to their center positions in the swaying motion. The biasing means as shown in the drawings preferably comprises at least one forward, extensible, elastic cord 60 having first and second ends. As illustrated, there are two such elastic cords 60. The first ends of the elastic cords 60 are attached to a forward end of the platform 30. As shown in the drawings, the first ends of the elastic cords 60 are connected to the forward corners of the platform 30.

A forward pulley 62 is provided for each forward, elastic cord 60 that is attached to the forward end of the platform 30. As illustrated, two such pulleys 62 are attached to the forward member and positioned at a height at least as high as the greatest height that the platform 30 attains in its swinging, arcuate movement. In the embodiment illustrated in the drawings, an intermediate cross member 46 is attached between the upstanding elongate legs 40 of the forward member, and the pulleys 62 are suspended from the cross member 46. The forward, elastic cords 60 extend from the platform 30 around the forward pulleys 62 toward the elongate element 14 which forms the front end of the base support member. The second ends of the forward, elastic cords 60 are then attached to the elongate element 14 that forms the front end of the base support member.

The biasing means as illustrated in the drawings further comprises at least one rearward, extensible, elastic cord 70 having first and second ends. The first ends of the elastic cords 70 are attached to a rearward end of the platform 30. As shown in the drawings, the first ends of the elastic cords 70 are connected to the rearward corners of the platform 30.

A rearward pulley 72 is provided for each rearward, elastic cord 70 that is attached to the rearward end of the platform 30. As illustrated, two such pulleys 72 are attached to the rearward member and positioned at a height at least as high as the greatest height that the platform 30 attains in its swinging, arcuate movement. In the embodiment shown in the drawings, the pulleys 72 are suspended from the cross member 52 that forms the base of the second, inverted, U-shaped member forming the rearward member of the exercise device. The rearward elastic cords 70 extend from the platform 30 around the rearward pulleys 72 toward the elongate element 16 which forms the rear end of the base support member. The second ends of the rearward, elastic cords 70 are attached to the elongate element 16 that forms the rear end of the base support member.

The elastic cords 60 and 70 as illustrated form ideal biasing means. The elastic cords 60 and 70 elongate sufficiently to allow the platform 30 to move in a wide arc. Sufficient force is applied to the platform 30 to result in a substantial workout for a person exercising on the device. Although the elastic cords 60 and 70 are presently preferred and form very inexpensive biasing mans, it should be recognized that other elastic or spring means could be used in association with the elongate support member 22 or the platform 30 to bias these members to their desired center positions in their swaying movement.

It is advantageous to provide means for varying the bias force exerted on the elongate support member 22 and platform 30. As shown in the drawings, such means includes a plurality of loops 80 that are spaced outwardly from the center of each of the elongate elements 14 and 16. The second ends of the cords 60 and 70 are provided with hooks that releasably engage the respective loops 80. To increase biasing force, the hooks on the second ends of the cords 60 and 70 are moved away from loops 80 near the center portion of the elongate elements 14 and 16 to loops 80 that are further removed from the center portion.

In the embodiment of the exercise device shown in FIG. 3, the platform 30 has an upper foot receiving surface 31 that can rotate about a central axis through the platform 30. The central axis is perpendicular to the upper surface 31 of the platform 30, whereby a user standing on the platform can pivot his or her feet while pushing the platform 30 back and forth in its swaying motion.

In the embodiment of the exercise device shown in FIGS. 4 and 5, the platform 30 is bifurcated into two spaced apart, side-by-side sections 33 and 35 having adjacent, facing sides that are substantially parallel with each other and also substantially parallel with the pivot axis formed by the pivot rod 24. To accommodate the bifurcated platform 30, there are first and second elongate support members 22 that are pivotally attached in side-by-side relationship to the longitudinal beam 18 for pivoting about a common axis formed by the pivot rod 24. Both the elongate support members 22 extend upwardly from the base support member so that both elongate support members 22 sway back and forth above the base support member similar to the motion of the single elongate support member 22 of the embodiment illustrated in FIGS. 1-3.

In the embodiment of FIGS. 4 and 5, the distal end of the first elongate support member 22 is pivotally attached to one of the sections 33 of the platform 30, and the distal end of the second elongate support member 22 is pivotally attached to the other of the sections 35 of the platform 30. The sections 33 and 35 of the platform 30 are held in their side-by-side relationship by a pair of rigid connectors 37 at the forward and backward ends, respectively, of the platform 30. Each of the connectors 37 are pivotally connected at their opposite ends to respective sections 33 and 35 of the platform 30 to hold the sections 33 and 35 spaced from each other and to allow the sections 33 and 35 to move up and down relative to each other as the platform moves in its arcuate, swinging motion.

As shown in FIG. 5, when the platform 30 is in its off center position, such as at the right position as shown in FIG. 5. the outer section 35 of the platform 30 is lower than the inner section 33. In a corresponding left position, although not shown in the drawings, section 33 becomes the outer section and it is lower than the section 35 which is then the inner section. At the center position of the swaying movement of the platform 30, the sections 33 and 35 are at the same elevation relative to each other.

Biasing means, such as the elastic cords 60 and 70 of the embodiments of FIGS. 1-3 of the drawings, are attached to the outer corners of the respective sections 33 and 35 of the bifurcated platform 30 of the embodiment of the exercising device shown in FIGS. 4 and 5. The biasing cords 60 and 70 act as described hereinbefore to exert a biasing force on both of the elongate members 22 and the bifurcated platform 30 to bias the support members 22 to an upstanding position lying closely adjacent to a vertical plane through the pivot axis formed by the pivot rod 24. The platform 30 is biased toward a position in which the space between the two sections 33 and 35 of the platform 30 lies in the vertical plane through the pivot axis.

Although preferred embodiments of the exercise device of the present invention have been illustrated and described, it is to be understood that the present disclosure is made by way of example and that various other embodiments are possible without departing from the subject matter coming within the scope of the following claims, which subject matter is regarded as the invention.

I claim:

1. An exercise device that simulates downhill skiing to develop skiing skills as well as to thoroughly exercise one's body and cardiovascular system, said exercise device comprising a frame including a base support member that rests on the floor or ground, said base support member having a front end, a back end and a longitudinal axis extending from the front end to the back end;

an elongate support member that is pivotally attached to said frame for pivotal, swaying movement about a pivot axis that is substantially parallel with said longitudinal axis of said base support, with said elongate support member extending upwardly from said base support member whereby said elongate support member sways back and forth above said base support member;

biasing means associated with said elongate support member for exerting a biasing force on the elongate support member to bias the elongate support member toward an upstanding position lying in a vertical plane through said pivot axis;

a platform for supporting a person in a standing position thereon, said platform being pivotally attached to a distal end of said elongate support member that extends upwardly from said base support member, whereby as said elongate support member sways back and forth, said platform moves in an arcuate, swinging motion in a substantially vertical plane that is substantially perpendicular to said pivot axis;

said biasing means comprising at least one elongate spring biasing member attached at its distal ends to said frame, and attached to said platform intermediate said distal ends; and said frame further including a forward member extending upwardly from the front end of said base support member, said forward member including hand engagement means which a person standing on said platform can grasp to maintain balance as the person pushes said platform downwardly in alternating movements first to one side of said vertical plane extending through said pivot axis and then to the other side of said vertical plane extending through said pivot axis in a motion simulating turns in downhill skiing.

2. An exercise device in accordance with claim 1 further including means for varying the bias force exerted on said elongate support member.

3. An exercise device in accordance with claim 1 wherein said platform has an upper foot receiving surface that can rotate about a central axis through said platform, said central axis being perpendicular to said upper surface of said platform whereby the users standing on the platform can pivot their feet while pushing the platform back and forth in its swaying motion.

4. An exercise device that simulates downhill skiing to develop skiing skills as well as to thoroughly exercise one's body and cardiovascular system, said exercise device comprising a frame including a base support member that rests on the floor or ground, said base support member having a front end, a back end and a longitudinal axis extending from the front end to the back end;

an elongate support member that is pivotally attached to said longitudinal beam for pivotal, swaying movement about a pivot axis that is substantially parallel with said longitudinal axis of said base support, with said elongate support member extending upwardly from said base support member whereby said elongate support member sways back and forth above said base support member;

biasing means associated with said elongate support member for exerting a biasing force on the elongate support member to bias the elongate support member toward an upstanding position lying in a vertical plane through said pivot axis;

a platform for supporting a person in a standing position thereon, said platform being pivotally attached to a distal end of said elongate support member that extends upwardly from said base support member, whereby as said elongate support member sways back and forth, said platform moves in an arcuate, swinging motion in a substantially vertical plane that is substantially perpendicular to said pivot axis;

said frame further including a forward member extending upwardly from the front end of said base support member, said forward member including hand engagement means which a person standing on said platform can grasp to maintain balance as the person pushes said platform downwardly in alternating movements first to one side of said vertical plane extending through said pivot axis and then to the other side of said vertical plane extending through said pivot axis in a motion simulating turns in downhill skiing;

said forward member comprises an inverted, U-shaped member having two upstanding elongate legs attached at respective one ends thereof to said front end of said base support member, with the upper ends of said upstanding elongate legs being connected together by an elongate cross member that forms the base of the inverted, U-shaped member; and said hand engagement means comprises a pair of spaced apart, elongate, hand grip members extending substantially upwardly from said elongate cross member.

5. An exercise device in accordance with claim 4 further including a rearward member comprising a second, inverted, U-shaped member that has two upstanding elongate legs attached at respective one ends thereof to said back end of said base support member, with the upper ends of said upstanding elongate legs of said rearward member being connected together by an elongate cross member that forms the base of the second, inverted, U-shaped member.

6. An exercise device in accordance with claim 5 further including a seat mounted on the elongate cross member that forms the base of the second, inverted, U-shaped member.

7. An exercise device in accordance with claim 5 wherein said biasing means comprises at least one forward, extensible, elastic cord having first and second ends, with the first end thereof being attached to a forward end of said platform;

a forward pulley for each forward, elastic cord that is attached to the forward end of said platform, said forward pulley being attached to said forward member and positioned at a height at least as high as the greatest height that the platform attains in its swinging, arcuate movement, with said forward, elastic cord extending from said platform around said forward pulley toward said front end of said base support member;

means for attaching the second end of said forward, elastic cord to said front end of said base support member;

at least one rearward, extensible, elastic cord having first and second ends, with the first end thereof being attached to a rearward end of said platform;

a rearward pulley for each rearward, elastic cord that is attached to the rearward end of said platform, said rearward pulley being attached to said rearward member and positioned at a height at least as high as the greatest height that the platform attains in its swinging, arcuate movement, with said rearward elastic cord extending from said platform around said rearward pulley toward said rear end of said base support member; and means for attaching the second end of said rearward, elastic cord to said rear end of said base support member.

8. An exercise device that simulates downhill skiing to develop skiing skills as well as to thoroughly exercise one's body and cardiovascular system, said exercise device comprising a frame including a base support member that rests on the floor or ground, said base support member having a front end, a back end and a longitudinal axis extending from the front end to the back end;

an elongate support member that is pivotally attached to said longitudinal beam for pivotal, swaying movement about a pivot axis that is substantially parallel with said longitudinal axis of said base support, with said elongate support member extending upwardly from said base support member whereby said elongate support member sways back and forth above said base support member;

biasing means associated with said elongate support member for exerting a biasing force on the elongate support member to bias the elongate support member toward an upstanding position lying in a vertical plane through said pivot axis;

a platform for supporting a person in a standing position thereon, said platform being pivotally attached to a distal end of said elongate support member that extends upwardly from said base support member, whereby as said elongate support member sways back and forth, said platform moves in an arcuate, swinging motion in a substantially vertical plane that is substantially perpendicular to said pivot axis;

said frame further including a forward member extending upwardly from the front end of said base support member, said forward member including hand engagement means which a person standing on said platform can grasp to maintain balance as the person pushes said platform downwardly in alternating movements first to one side of said vertical plane extending through said pivot axis and then to the other side of said vertical plane extending through said pivot axis in a motion simulating turns in downhill skiing.

said platform is bifurcated into two spaced apart, side-by-side sections having adjacent, facing sides that are substantially parallel with each other and also substantially parallel with said pivot axis;

there are first and second elongate support members that are pivotally attached in side-by-side relationship to said longitudinal beam for pivoting about a common axis that is substantially parallel with said longitudinal axis of said base support, with both said elongate support members extending upwardly from said base support member so that both said elongate support members sway back and forth above said base support member;

the distal end of the first elongate support member is pivotally attached to one of the sections of said platform;

the distal end of the second elongate support member is pivotally attached to the other of the sections of said platform;

said biasing means is associated with both said elongate support members for exerting a biasing force on each elongate support member to bias each elongate support member toward an upstanding position lying closely adjacent to a vertical plane through said pivot axis;

said sections of said platform being held in their side-by-side relationship by a pair of rigid connectors at the forward and backward ends, respectively, of said platform; and each of said connectors being pivotally connected at their opposite ends to respective sections of said platform to hold the sections spaced from each other and to allow the sections to move up and down relative to each other as said platform moves in its arcuate, swinging motion.

* * * * *